US010113333B2

(12) United States Patent
Lanusse

(10) Patent No.: US 10,113,333 B2
(45) Date of Patent: Oct. 30, 2018

(54) BOLT TO PIN WITH INTERCHANGEABLE COMBINATION

(71) Applicant: Patricio Lanusse, Buenos Aires (AR)

(72) Inventor: Patricio Lanusse, Buenos Aires (AR)

( * ) Notice: Subject to any disclaimer, the term of this patent is extended or adjusted under 35 U.S.C. 154(b) by 0 days.

(21) Appl. No.: 15/402,281

(22) Filed: Jan. 10, 2017

(65) Prior Publication Data

US 2018/0195314 A1 Jul. 12, 2018

(51) Int. Cl.

| | |
|---|---|
| ***E05B 37/02*** | (2006.01) |
| ***E05B 65/00*** | (2006.01) |
| ***E05B 37/00*** | (2006.01) |

(52) U.S. Cl.

CPC ..... *E05B 37/02* (2013.01); *E05B 37/0048* (2013.01); *E05B 37/0058* (2013.01); *E05B 65/0007* (2013.01)

(58) Field of Classification Search

CPC .. E05B 37/00; E05B 37/0048; E05B 37/0058; E05B 37/02; E05B 37/025; E05B 71/00

See application file for complete search history.

(56) References Cited

U.S. PATENT DOCUMENTS

| | | | | |
|---|---|---|---|---|
| 3,416,338 | A | 12/1968 | Gehrie | |
| 6,796,152 | B1 | 9/2004 | Yu | |
| 7,185,518 | B1 * | 3/2007 | Huang | E05B 73/0082 70/14 |
| 7,444,844 | B1 * | 11/2008 | Lee | E05B 37/0034 70/21 |
| 8,297,087 | B1 * | 10/2012 | Lin | E05B 37/0058 70/26 |
| 9,562,369 | B2 * | 2/2017 | Kuo | E05B 37/0048 |
| 2007/0157681 | A1 * | 7/2007 | Miao | E05B 27/083 70/58 |
| 2007/0245777 | A1 * | 10/2007 | Miao | E05B 73/0005 70/58 |
| 2007/0277566 | A1 | 12/2007 | Yu | |
| 2011/0041574 | A1 * | 2/2011 | Yang | E05B 37/02 70/315 |
| 2014/0060125 | A1 * | 3/2014 | Yang | E05B 73/0082 70/15 |
| 2014/0250952 | A1 * | 9/2014 | Lai | E05B 37/0034 70/14 |
| 2017/0138089 | A1 * | 5/2017 | Yang | E05B 37/0055 |

FOREIGN PATENT DOCUMENTS

| | | |
|---|---|---|
| ES | 201838 | 3/1952 |
| ES | 256042 | 6/1960 |
| ES | 482109 | 4/1980 |
| ES | 8202395 | 4/1982 |
| ES | 8308962 | 12/1983 |
| ES | 2461817 | 5/2014 |

* cited by examiner

*Primary Examiner* — Christopher J Boswell
(74) *Attorney, Agent, or Firm* — Defillo & Associates; Evelyn A. Defillo

(57) ABSTRACT

The invention refers to a bolt to pin lock with interchangeable combination to be used mainly in gates, cold storage rooms, commercial vehicles, containers, wagons manufacturing facilities, and doors.

1 Claim, 4 Drawing Sheets

BOLT TO PIN WITH INTERCHANGEABLE COMBINATION

FIELD OF THE INVENTION

The invention refers to a bolt pin with an interchangeable combination that can be used mainly in gates, cold storage rooms, commercial vehicles, containers, wagons manufacturing facilities, and doors.

PRIOR ART

They are known as the combination locks that have several different uses, being the ones for suitcases or for computers, the most used and the most similar to this invention.

As can be seen, for example US 2007277566, U.S. Pat. No. 6,796,152, ES 8202395 documents with priority US 19800149520, US 19800513, U.S. Pat. No. 3,416,338, ES 2,461,817, ES 256042 (A2), ES 482109 (A1), ES 8308962 (A1), and ES 201838 (A1) in all these documents you find variations to the Gehrie's lock, which was one of the most important improvements for combination locks, but in the present invention there are still improvements that simplify the locks making them even more simple and where also possible to change the combination. Therefore, the present invention is a mechanical simplification in bolt pins with interchangeable combination and can be used in new applications, even on gates with ring closure or guillotine type.

Taking the Spanish Patent ES 2461817, in our opinion considered one of the most closest prior art, it can be seen that the document refers to a blocking device with changeable combination numbers to block a port connection on a computer and prevent the connection to any other external storage device and mainly includes a housing, a locking unit, and a push button. The housing has an insert with two holes resembling a USB plug, a seat, a series of support windows, and a plate. The locking unit includes a rod with a line of teeth, a push, an elastic medium, a plurality of couplings, and rotating disks. The couplings include arms to dismantle the disks in the inclusion section. While the present invention includes a main shaft with teeth and two built-in rollers, a primary and a secondary, where can be seen among others differences a decrease among the components of both locks that reflects the important difference between the bolts that are on the market and the simplicity of the lock of the present invention.

BRIEF DESCRIPTION OF THE FIGURES

For greater clarity and understanding of the present invention, it is shown in different figures the preferred embodiments only as an example.

The latch mechanism is described in 4 pages, which are and contain.

DESCRIPTION OF THE INVENTION

Figure 1:
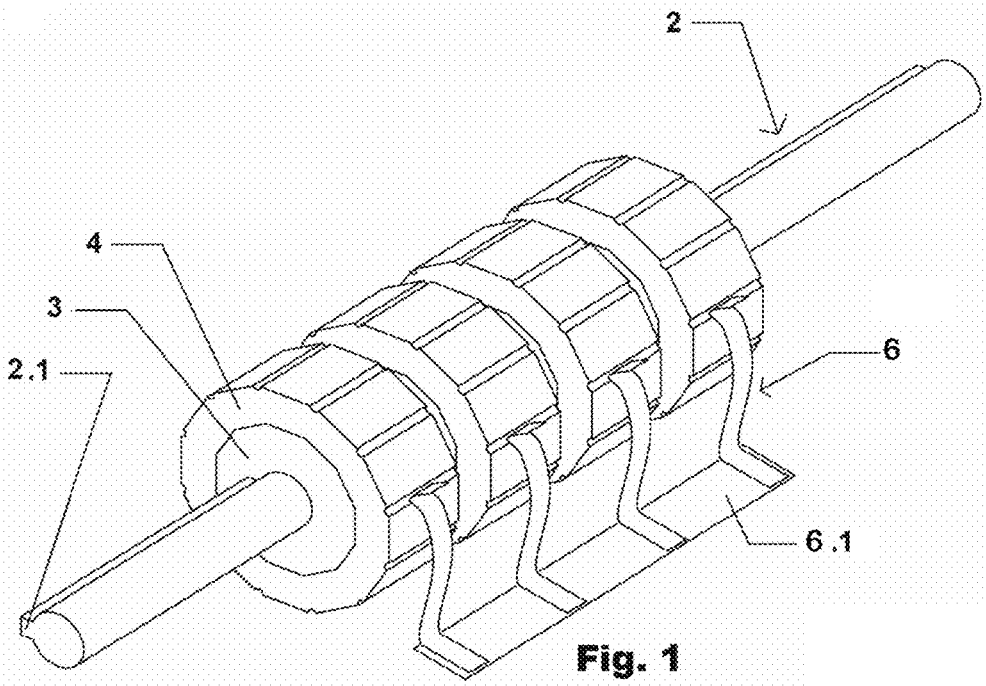
FIG. 1—a perspective axonometric view of the mechanism bolt to pin with interchangeable combination showing parts of the main shaft with the cotter pin and the rollers.

The invention refers to bolt to pin lock with interchangeable combination that can be used mainly in gates, cold storage rooms, commercial vehicles, containers, wagons manufacturing facilities, and doors. The mechanism includes a main metal shaft, a through bolt with a long ridge as a key and discontinuous in some parts according to the need; on the metal shaft includes a few overlapping pulley wheels and interchangeable in their position, thus allowing to choose the desired combination according to printed numbers in the pulley wheels (from 0 to 9) only moving and using the axis on its shaft.

Therefore, the bolt mechanism allows to program the numerical combination of either 1, 2, 3 or 4-digit, as in this case, according to the number of pulley wheels that have the device.

The mechanism is complemented by a box base, a cover, one end or handle, and other end or latch locks.

The mechanism is described in terms of its parts in the following manner:

A shaft (2) has a round section with a long edge pin (2.1) on its edge. The pin (2.1) includes a discontinuous section (2.2) in some parts according to the need. An internal roller (3) is inserted on the shaft (2). The internal roller (3) having an external face (3.1), an internal face (3.2) with a borehole including a groove (3.3) to be secured in position on the ridge of the shaft (2).

An external roller (4) includes an internal face (4.1) and a segmented external face (4.4). Slots 4.2 separate adjacent segments of the external face that leave his position fixed and not be able to move. Each segmented external face 4.4 includes printed numbers (4.3) from 0-9.

The internal roller (3) and the external roller have a decagonal faceted edge (3.1) which allows therefore to set 10 different positions.). t The bolt includes a housing (1) that covers the mechanism of the weather inclemency. The housing (1) includes a base end (1.1) and a top end (1.2). A support (9) is placed on an extension (1.4) of the base end (1.1). The support (9) has a pivoting movement with the locking device (8) or with the bar (11) depending on the type of gate. The housing (1) includes a a number of cuts (1.4.1), (1.4.2), (1.4.3) or (1.4.4) depending on the number of rollers proposed for the number of combinations that have the bolt; The cuts form windows that allow viewing and modifying the positions of the external roller g device (4). Inside the housing (1) there are dividing walls (1.3) that are crossed by the main shaft (2). The shaft (2) has at one end a lever command (13) and the other end acts to lock and unlock latch of the lock. In the case of being used in gates, it is responsible for triggering the pivot system (10) that fixed the locking device (8) to the post (11) at the time of lock. In the case of guillotine type gates (11 is positioned it within the post (13). The main shaft (2)

is fixed with the triggering the pivot system (10) which triggers the guillotine and locked in that is a support of the guillotine with a "U" shape and separate from the bolt. These elements both pole with the wheel, or the support with the guillotine are ultimately those who lock or unlock the aperture of the lock and both are powered by the bolt to pin lock with interchangeable combination.

On the shaft (2) are placed overlapping or rollers (3, 4) that are interconnected between them. The external faces (3.1) of the internal roller (3) are interconnected with the internal face (4.1) of the external roller. The position between the rollers can be interchangeable, thus allowing choosing the combination desired, according to the number of faces (4.4) of the external roller (4) and on the basis of printed numbers (4.3) on the faces (4.4) of the external roller.

When the shaft (2) is located in the correct position, i.e. the edge pin (2.1) coincides with the guides (3.3) of the rollers (3). The shaft may slip and unlocks the bolt, ring or guillotine as the case may be. The correct location of the shaft with the roller corresponds to a single possible combination that has been previously adopted. The spaces (2.2) are spaces of free spins of the rollers and have the measurement of the width of the pulley wheels or rollers (3). When groove (3.3) of the roller (3) corresponds to the key (2.1) allows the sliding of the main axis for the opening or closing of the bolt lock, and when the spaces do not match (2.2) with (3.3), the bolt lock is unable to open or close. The straps (6), when it is positioned in the slots (4.2), allows an individual roller locking preventing these are under control, the straps (6) have a base (6.1) that are anchored in the housing (1). For the case that the bolt to pin with interchangeable combination is used both in type lock gates with ring or guillotine type, the base (1.4) on the box base, is extended up to the end (9) which pivots the ring (8) as the guillotine (11) and that through a cardan system (10) is fixed to the end of the shaft (2) to trigger the closing or opening of the lock type guillotine (11) or ring (8).

DETAIL OF THE FIGURES

Figure 2:
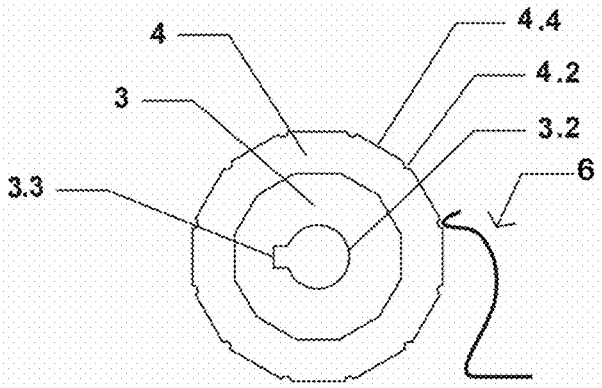
FIG. 2—a front view of the bolt to pin with interchangeable combination lock with rollers and the locking of one digit.
Figure 3:
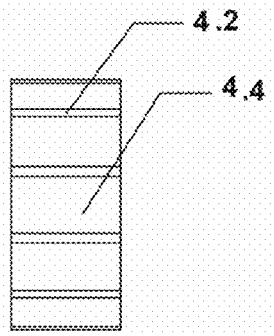
FIG. 3—side view of the bolt to pin with interchangeable combination lock showing the faces and the locking groove.
Figure 4:
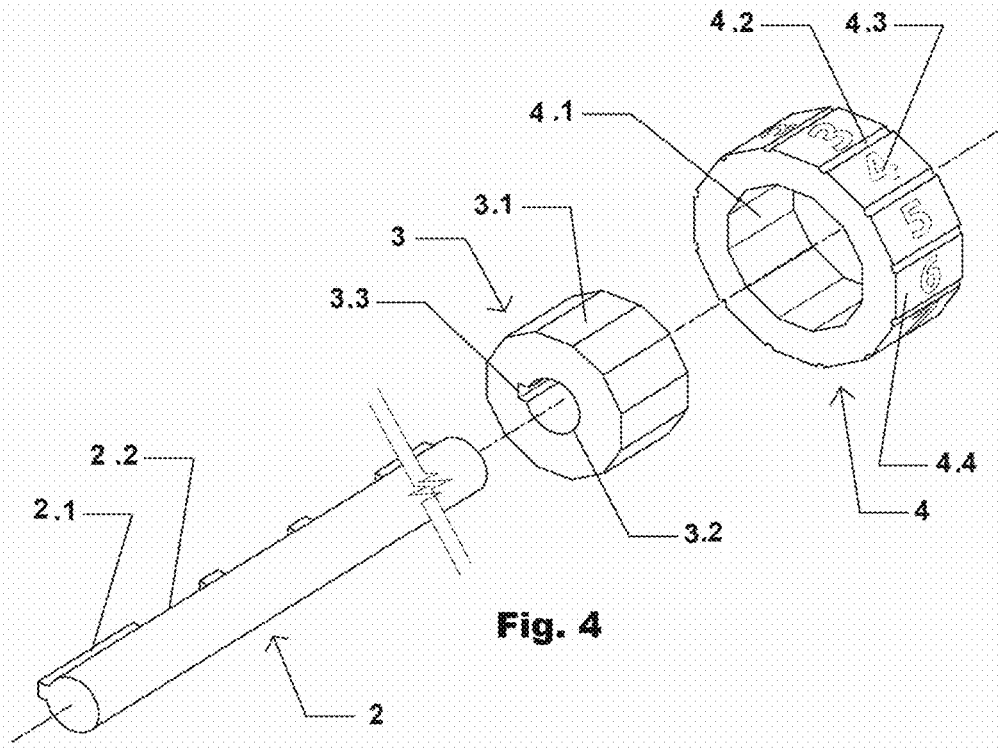
FIG. 4—perspective axonometric view of the bolt to pin with interchangeable combination exploded of one digit.
Figure 5:
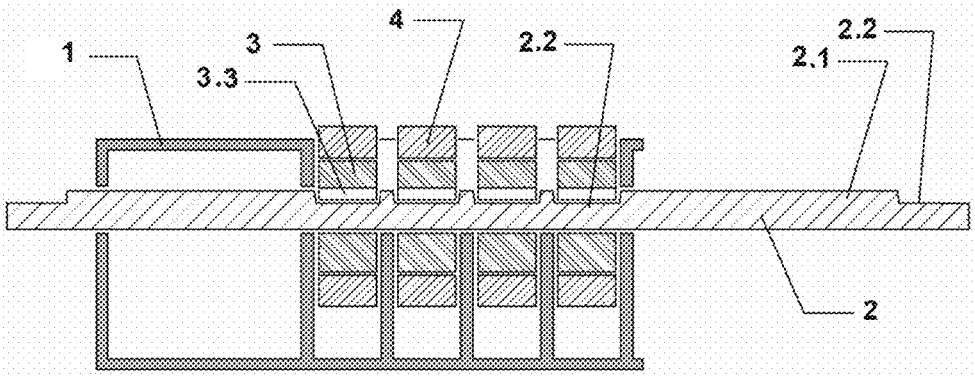
FIG. 5—a longitudinal cut view of the base box and cover of the bolt to pin lock with interchangeable combination lock.
Figure 6:
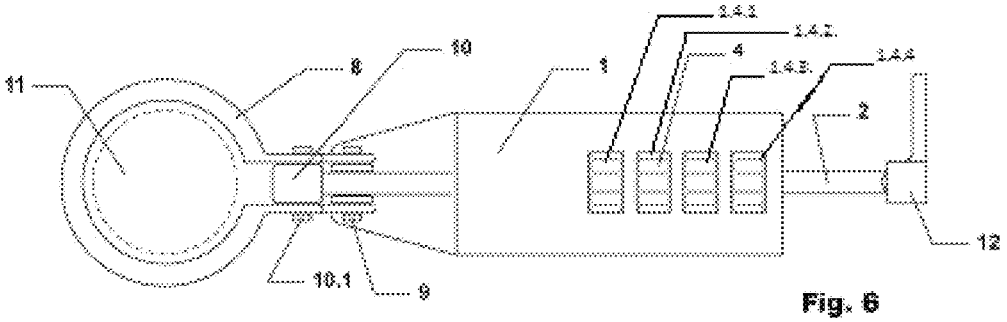
FIG. 6—top view of base box and cover of the bolt to pin lock with interchangeable combination lock, with anchor ring to seal in the gate post.
Figure 7:
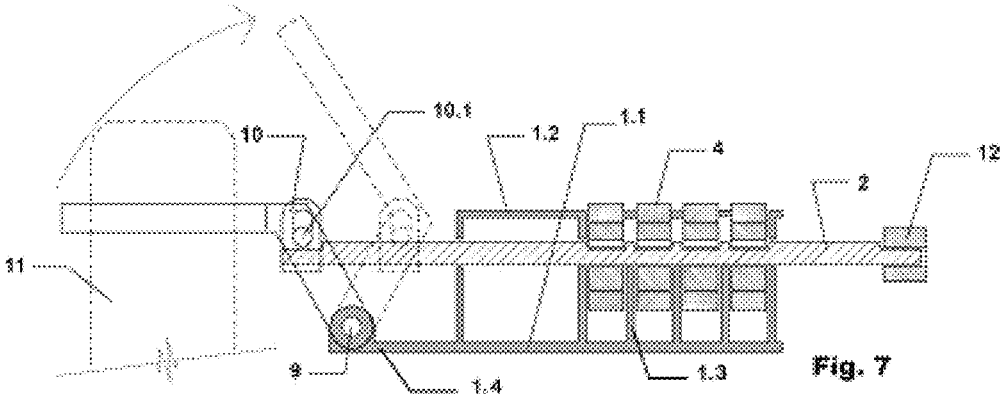
FIG. 7—shows a longitudinal cut view of the previous figure.
Figure 8:
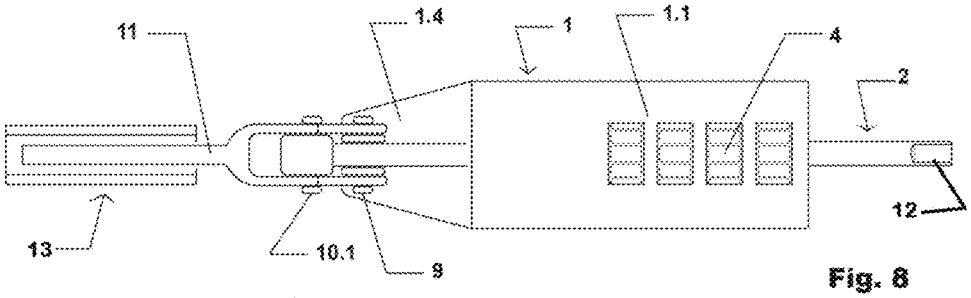
FIG. 8—top view of the base box and cover of the bolt to pin lock mechanism, with extreme closure by way of descending drive guillotine over fixed base.
Figure 9:
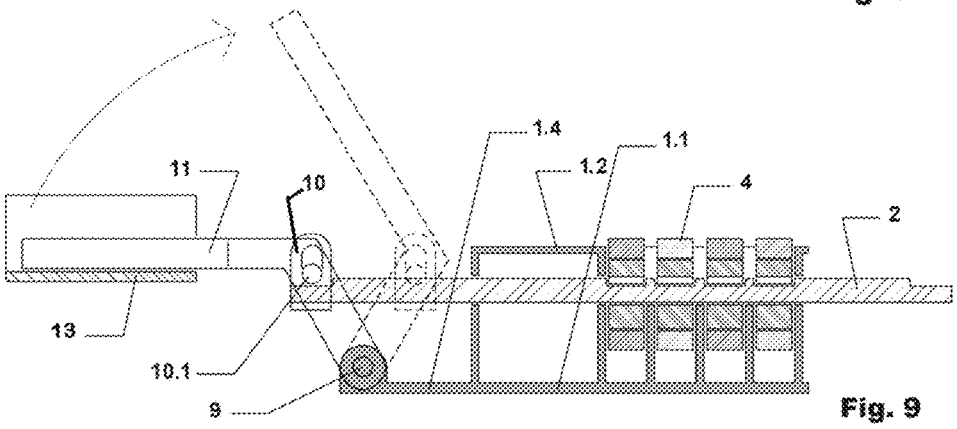
FIG. 9.—longitudinal cut view of the previous figure.

2: shaft
2.1: pin
3: internal roller
4: external roller
6: strap
6.1: base of the strap
FIG. 2:
3: internal roller
3.2: internal face of the internal roller
3.3: groove
4: external roller
4.2: slots
4.4: external face of the external roller
6: strap
FIG. 3:
4.2: slot
4.4: external face of the external roller
FIG. 4
2: shaft
2.1: pin
2.2: discontinued section
3: internal roller
3.1: external face of the internal roller
3.2: internal face of the internal roller
3.3: groove
4: external roller
4.1: internal face of the external roller
4.2: slot
4.3: numbering of the external face
4.4: external face of the external roller
FIG. 5:
1: housing
2: shaft
2.1: pin
2.2: discontinued section
3: internal r roller
3.3: groove
4: external roller
FIG. 6:
1: housing
2: shaft
4: external roller
8: ring
9: support
10: cardan system
10.1: mobile fixing
11: post
12: handle
FIG. 7:
1.1: base end of the housing
1.2: top end of the housing
1.3: internal division of the housing
1.4: extension of the bottom base
2: shaft
4: external roller
9: support
10: cardan system
10.1: mobile fixing
14: post
12: handle
FIG. 8:
1: housing
2: shaft
4: external roller
9: support
10.1: mobile fixing
11: guillotine
12: handle
13: support of guillotine
FIG. 9:
1.1: base end of the housing
1.2: top end of the housing
1.4: extension of the bottom base
2: shaft
4: external roller
9: support
10: cardan system
10.1: mobile fixing
11: guillotine
13: support of guillotine

The invention claimed is:

1. A bolt lock consisting of:
a housing having:
a base end;
a shaft crossing through the housing, the shaft has a pin on an edge of the shaft, the pin including sections with ridges and sections without ridges;
a top end;
a plurality of cuts located on the top end;
a plurality of dividing walls inside the housing, the main shaft crossed through the dividing walls;
an external roller placed on each one of the cuts, the external rollers are separated by the dividing walls, the external rollers including an internal face and an external face having a plurality of segments separated by slots;

an internal roller placed inside each one of the external rollers, each one of the internal rollers having an internal face, an external face having a faceted edge, a borehole including a groove, the main shaft crossing through each one of the external rollers and the internal rollers;

a support placed on an extension of the base end of the housing, the support has a pivoting movement with a locking device located outside the housing;

a strap located at each one of the slots, the straps are fixed into a strap base anchored to the housing;

wherein when the edge pin of the main shaft coincides with groove of the internal roller, the main shaft slips and unlocks the bolt lock; and wherein when the edge pin of the main shaft does not coincide with groove of the internal roller, the bolt lock is locked.

* * * * *